United States Patent [19]

Adam et al.

[11] Patent Number: 4,879,095

[45] Date of Patent: Nov. 7, 1989

[54] RAPIDLY SOLIDIFIED ALUMINUM BASED SILICON CONTAINING, ALLOYS FOR ELEVATED TEMPERATURE APPLICATIONS

[75] Inventors: Colin M. Adam; Richard L. Bye, both of Morristown; Santosh K. Das, Randolph; David J. Skinner, Long Valley, all of N.J.

[73] Assignee: Allied-Signal Inc., Morris Township, Morris County, N.J.

[21] Appl. No.: 39,246

[22] Filed: Apr. 17, 1987

Related U.S. Application Data

[63] Continuation-in-part of Ser. No. 782,774, Oct. 2, 1985, abandoned.

[51] Int. Cl.[4] ..... C22C 21/00

[52] U.S. Cl. ..... 420/548; 75/249; 148/415; 148/437; 419/66; 419/67

[58] Field of Search ..... 148/415, 437; 419/66, 419/67; 420/548, 551; 75/249

[56] References Cited

U.S. PATENT DOCUMENTS

| | | | |
|---|---|---|---|
| 2,963,780 | 12/1960 | Lyle et al. | 29/182 |
| 2,967,351 | 1/1961 | Roberts et al. | 29/420.5 |
| 3,462,248 | 8/1969 | Roberts et al. | 29/182 |
| 4,347,076 | 8/1982 | Ray et al. | 75/249 |
| 4,379,719 | 4/1983 | Hildeman et al. | 420/550 |

OTHER PUBLICATIONS

P. T. Millan, Jr.; *Journal of Metals,* vol. 35(3), p. 76, 1983.

*Primary Examiner*—R. Dean

*Attorney, Agent, or Firm*—Ernest D. Buff; Gerhard H. Fuchs

[57] ABSTRACT

A rapidly solidified aluminum-base alloy consists essentially of the formula $Al_{bal}Fe_aSi_bV_c$, wherein "a" ranges from 3.0 to 7.1 atom percent, "b" ranges from 1.0 to 3.0 atom percent, "c" ranges from 0.25 to 1.25 atom percent and the balance is aluminum plus incidental impurities, with the provisos that (i) the ratio (Fe+V): Si ranges from about 2.33:1 to 3:33:1 and (ii) the ratio Fe:V ranges from 11.5:1 to 5:1. The alloy exhibits high strength, ductility and fracture toughness and is especially suited for use in high temperature structural applications such as gas turbine engines, missiles, airframes and landing wheels.

12 Claims, No Drawings

RAPIDLY SOLIDIFIED ALUMINUM BASED SILICON CONTAINING, ALLOYS FOR ELEVATED TEMPERATURE APPLICATIONS

CROSS-REFERENCE TO RELATED APPLICATIONS

This application is a continuation-in-part of U.S. Ser. No. 782,774, filed Oct. 2, 1985, abandoned for "Rapidly Solidified Aluminum based silicon containing alloys for elevated temperature applications."

BACKGROUND OF THE INVENTION

1. Field of the Invention

The invention relates to aluminum based, silicon containing, alloys having strength, ductility and toughness at ambient and elevated temperatures and relates to powder products produced from such alloys. More particularly, the invention relates to Al-Fe-Si-V alloys that have been rapidly solidified from the melt and thermomechanically processed into structural components having a combination of high strength, ductility and fracture toughness.

2. Brief Description of the Prior Art

Methods for obtaining improved tensile strength at 350° C. in aluminum based alloys have been described in U.S. Pat. Nos. 2,963,780 to Lyle, et al.; 2,967,351 to Roberts, et al.; and 3,462,248 to Roberts, et al. The alloys taught by Lyle, et al. and by Roberts, et al. were produced by atomizing liquid metals into finely divided droplets by high velocity gas streams. The droplets were cooled by convective cooling at a rate of approximately $10^{4°}$ C./sec. As a result of this rapid cooling, Lyle, et al. and Roberts, et al. were able to produce alloys containing substantially higher quantities of transition elements than has hitherto been possible.

Higher cooling rates using conductive cooling, such as splat quenching and melt spinning, have been employed to produce cooling rates of about $10^{5°}$ to $10^{6°}$ C./sec. Such cooling rates minimize the formation of intermetallic precipitates during the solidification of the molten aluminum alloy. Such intermetallic precipitates are responsible for premature tensile instability. U.S. Pat. No. 4,379,719 to Hildeman, et al. discusses rapidly quenched aluminum alloy powder containing 4 to 12 wt % iron and 1 to 7 wt % cerium or other rare earth metal from the lanthanum series. U.S. Pat. No. 4,347,076 to Adam discusses rapidly quenched aluminum alloy powder containing 5–15 wt. % Fe and 1–5 wt. % of other transition elements.

U.S. Pat. No. 4,347,076 to Ray, et al. discusses high strength aluminum alloys for use at temperatures of about 350° C. that have been produced by rapid solidification techniques. These alloys, however, have low engineering ductility and fracture toughness at room temperature which precludes their employment in structural applications where a minimum tensile elongation of about 3% is required. An example of such an application would be in small gas turbine engines discussed by P. T. Millan, Jr.; Journal of Metals, Volume 35(3), page 76, 1983.

Ray, et al. discussed aluminum alloys composed of a metastable, face-centered cubic, solid solution of transition metal elements with aluminum. The as cast ribbons were brittle on bending and were easily comminuted into powder. The powder was compacted into consolidated articles having tensile strengths of up to 76 ksi at room temperature. The tensile ductility or fracture toughness of these alloys was not discussed in detail in Ray, et al. However, it is known that (NASA REPORT NASI-17578 May 1984) many of the alloys taught by Ray, et al., when fabricated into engineering test bars do not posses sufficient room temperature ductility or fracture toughness for use in structural components.

Thus, conventional aluminum alloys, such as those taught by Ray, et al. have lacked sufficient engineering toughness. As a result, these conventional alloys have not been suitable for use in structural components.

SUMMARY OF THE INVENTION

The invention provides an aluminum based alloy consisting essentially of the formula $Al_{bal}Fe_aSi_bV_c$, "a" ranges from 3.0 to 7.1 at %, "b" ranges from 1.0 to 3.0 at %, "c" ranges from 0.25 to 1.25 at % and the balance is aluminum plus incidental impurities, with the provisos that i) the ratio (Fe+V):Si ranges from 2.33:1 to 3.33:1, and ii) the ratio Fe:V ranges from 11.5:1 to 5:1.

To provide the desired levels of ductility, toughness and strength needed for commercially useful applications, the alloys of the invention are subjected to rapid solidification processing, which modifies the alloy microstructure. The rapid solidification processing method is one wherein the alloy is placed into the molten state and then cooled at a quench rate of at least about $10^{5°}$ to $10^{7°}$ C./sec. to form a solid substance. Preferably this method should cool the molten metal at a rate of greater than about $10^6$C/sec, i.e. via melt spinning, spat cooling or planar flow casting which forms a solid ribbon or sheet. These alloys have an as cast microstructure which varies from a microeutectic to a microcellular structure, depending on the specific alloy chemistry. In alloys of the invention the relative proportions of these structures is not critical.

Consolidated articles are produced by compacting particles composed of an aluminum based alloy consisting essentially of the formula $Al_{bal}Fe_aSi_bV_c$, "a" ranges from 3.00 to 7.1 at %, "b" ranges from 1.0 to 3.0 at %, "c" ranges from 0.25 to 1.25 at % and the balance is aluminum plus incidental impurities, with the provisos that i) the ratio (Fe+V):Si ranges from 2.33:1 to 3.33:1, and ii) the ratio Fe:V ranges from 11.5:1 to 5:1. The particles are heated in a vacuum during the compacting step to a pressing temperature varying from about 300° to 500° C., which minimizes coarsening of the dispersed, intermetallic phases. Alternatively, the particles are put in a can which is then evacuated, heated to between 300° C. and 500° C., and then sealed. The sealed can is heated to between 300° C. and 500° C. in ambient atmosphere and compacted. The compacted article is further consolidated by conventionally practiced methods such as extrusion, rolling or forging.

The consolidated article of the invention is composed of an aluminum solid solution phase containing a substantially uniform distribution of dispersoid intermetallic phase precipitates of approximate composition $Al_{12}(Fe, X)_3Si_1$. These precipitates are fine intermetallics measuring less than 100 nm. in all linear dimensions thereof. Alloys of the invention, containing these fine dispersed intermetallics are able to tolerate the heat and pressure associated with conventional consolidation and forming techniques such as forging, rolling, and extrusion without substantial growth or coarsening of these intermetallics that would otherwise reduce the strength and ductility of the consolidated article to unacceptably low levels. Because of the thermal stability of the dispersoids in the alloys of the invention, the alloys can be used to produce near net shape articles, such as wheels, by forging, semi-finished articles, such as T-sections, by extrusion, and plate or sheet products by rolling that have a combination of strength and good ductility both at ambient temperature and at elevated temperatures of about 350° C.

Thus, the articles of the invention are more suitable for high temperature structural applications such as gas turbine engines, missiles, airframes, landing wheels etc.

Embodiments

To provide the desired levels of strength, ductility and toughness needed for commercially useful applications, rapid solidification from the melt is particularly useful for producing these aluminum based alloys. The alloys of the invention consist essentially of the formula $Al_{bal}Fe_aSi_bV_c$, "a" ranges from 3.0 to 7.1 at %, "b" ranges from 1.0 to 3.0 at %, "c" ranges from 0.25 to 1.25 at % and the balance is aluminum plus incidental impurities, with the provisos that (i) the ratio (Fe+V):Si ranges from about 2.33:1 to 3.33:1, and (ii) the ratio Fe:V ranges from 11.5:1 to 5:1. The rapid solidification processing typically employs a casting method wherein the alloy is placed into a molten state and then cooled at a quench rate of at least about $10^{5°}$ to $10^{7°}$ C./sec. on a rapidly moving casting substrate to form a solid ribbon or sheet. This process should provide provisos for protecting the melt puddle from burning, excessive oxidation and physical disturbances by the air boundary layer carried with along with a moving casting surface. For example, this protection can be provided by a shrouding apparatus which contains a protective gas; such as a mixture of air or $CO_2$ and $SF_6$, a reducing gas, such as CO or an inert gas; around the nozzle. In addition, the shrouding apparatus excludes extraneous wind currents which might disturb the melt puddle.

Rapidly solidified alloys having the $Al_{bal}Fe_aSi_bV_c$ compositions (with the provisos for (Fe+X):Si ratio and Fe:V ratio described above) have been processed into ribbons and then formed into particles by conventional comminution devices such as pulverizers, knife mills, rotating hammer mills and the like. Preferably, the comminuted powder particles have a size ranging from about 40 to 200 mesh, US standard sieve size.

The particles are placed in a vacuum of less than $10^{-4}$ torr ($1.33\times10^{-2}$ Pa.) preferably less than $10^{-5}$ torr ($1.33\times10^{-2}$ Pa.), and then compacted by conventional powder metallurgy techniques. In addition the particles are heated at a temperature ranging from about 300° to 550° C., preferably ranging from about 325° to 450° C., minimizing the growth or coarsening of the intermetallic phases therein. The heating of the powder particles preferably occurs during the compacting step. Suitable powder metallurgy techniques include direct powder extrusion by putting the powder in a can which has been evacuated and sealed under vacuum, vacuum hot compaction, blind die compaction in an extrusion or forging press, direct and indirect extrusion, conventional and impact forging, impact extrusion and the combinations of the above. Compacted consolidated articles of the invention are composed of a substantially homogeneous dispersion of very small intermetallic phase precipitates within the aluminum solid solution matrix. With appropriate thermomechanical processing these intermetallic precipitates can be provided with optimized combinations of size, e.g. diameter, and interparticle spacing. These characteristics afford the desired combination of high strength and ductility. The precipitates are fine, usually spherical in shape, measuring less than about 100 nm. in all linear dimensions thereof. The volume fraction of these fine intermetallic precipitates ranges from about 16 to 45%, and preferably, ranges from about 20 to 37% to provide improved properties. Volume fractions of coarse intermetallic precipitates (i.e.. precipitates measuring more than about 100 nm. in the largest dimension thereof) is not more than about 1%.

Compositions of the fine intermetallic precipitates found in the consolidated article of the invention is approximately $Al_{12}(Fe,V)_3Si_1$. For alloys of the invention this intermetallic composition represents about 95 to 100%, and preferably 100%, of the fine dispersed intermetallic precipitates found in the consolidated article. The addition of vanadium to Al-Fe-Si alloys when describing the alloy composition as the formula $Al_{bal}Fe_aSi_bV_c$ (with the (Fe+V):Si and Fe:V ratio provisos) stabilizes this metastable quaternary intermetallic precipitate resulting in a general composition of about $Al_{12}(Fe, V)_3Si_1$. The (Fe+V):Si and Fe:V ratio provisos define the compositional boundaries within which about 95–100%, and preferably 100% of the fine disposed intermatallic phases are of this general composition.

The prefered stabilized intermetallic precipitate has a structure that is body centered cubic and a lattice parameter that is about 1.25 to 1.28 nm.

Alloys of the invention, containing this fine dispersed intermetallic precipitate, are able to tolerate the heat and pressure of conventional powder metallurgy techniques without excessive growth or coarsening of the intermetallics that would otherwise reduce the strength and ducility of the consolidated article to unacceptably low levels. In addition, alloys of the invention are able to withstand unconventionally high processing temperatures and withstand long exposure times at high temperatures during processing. Such temperatures and times are encountered during the production at near net-shape articles by forging and sheet or plate by rolling, for example. As a result, alloys of the invention are particularly useful for forming high strength consolidated aluminum alloy articles. The alloys are particularly advantageous because they can be compacted over a broad range of consolidation temperatures and still provide the desired combinations of strength and ductility in the compacted article.

Further, by ensuring that about 95–100%, preferably 100% of the fine dispersed intermetallic phase are of the general composition $Al_{12}(Fe,V)_3Si_1$, by the application of the (Fe+V):Si and Fe:V ratio provisos, applicable engineering properties can be enhanced, such as crack growth resistance and fracture toughness.

The following examples are presented to provide a more complete understanding of the invention. The specific techniques, conditions, materials, proportions of the invention are exemplary and should not be construed as limiting the scope of the invention.

EXAMPLES 1 to 24

Alloys of the invention were cast according to the formula and method of the invention and are listed in Table 1.

TABLE 1

1. $Al_{93.55}Fe_{4.24}V_{0.44}Si_{1.77}$

2. $Al_{93.56}Fe_{4.13}V_{0.44}Si_{1.86}$
3. $Al_{93.52}Fe_{4.03}V_{0.58}Si_{1.86}$
4. $Al_{92.93}Fe_{4.77}V_{0.48}Si_{1.86}$
5. $Al_{92.92}Fe_{4.67}V_{0.59}Si_{1.86}$
6. $Al_{92.93}Fe_{4.49}V_{0.75}Si_{1.86}$
7. $Al_{92.39}Fe_{5.12}V_{0.51}Si_{1.99}$
8. $Al_{92.41}Fe_{4.99}V_{0.62}Si_{1.99}$
9. $Al_{92.36}Fe_{4.84}V_{0.81}Si_{1.99}$
10. $A_{93.52}Fe_{4.06}V_{0.75}Si_{1.67}$
11. $Al_{93.57}Fe_{4\ 29}V_{0.47}Si_{1.67}$
12. $Al_{94.12}Fe_{3.92}V_{0.50}Si_{1.46}$
13. $Al_{93.22}Fe_{4.33}V_{0.73}Si_{1.72}$
14. $Al_{90.82}Fe_{6.06}V_{0.65}Si_{2.47}$
15. $Al_{93.46}Fe_{4.37}V_{0.47}Si_{1.70}$
16. $Al_{93.45}Fe_{4.27}V_{0.58}Si_{1.70}$
17. $Al_{93.44}Fe_{4.11}V_{0.75}Si_{1.70}$
18. $Al_{91.92}Fe_{5.40}V_{0.59}Si_{2.10}$
19. $Al_{91.88}Fe_{5.29}V_{0.73}Si_{2.10}$
20. $Al_{91.89}Fe_{5.09}V_{0.93}Si_{2.09}$
21. $Al_{91.44}Fe_{5.73}V_{0.62}Si_{2.22}$
22. $Al_{91.45}Fe_{5.57}V_{0.76}Si_{2.21}$
23. $Al_{91.42}Fe_{5.36}V_{0.99}Si_{2.22}$
24. $Al_{89.29}Fe_{7.07}V_{0.77}Si_{2.86}$

EXAMPLES 25 to 33

Table 2 below shows the mechanical properties of specific alloys measured in uniaxial tension at a strain rate of approximately $5\times10^{-4}$/sec. and at various elevated temperatures. Each selected alloy powder was vacuum hot pressed at a temperature of 350° C. for 1 hr. to produce a 95 to 100% density preform slug. These slugs were extruded into rectangular bars with an extrusion ratio of 18:1 at 385° to 400° C. after holding at that temperature for 1 hr.

Ultimate Tensile Strength (UTS), MPa and Elongation to Fracture ($e_f$)%

| EXAMPLE | ALLOY | | TEST TEMPERATURE (°C.) 20 | 150 | 204 | 260 | 315 |
|---|---|---|---|---|---|---|---|
| 25 | $Al_{93.44}Fe_{4.11}V_{0.75}Si_{1.70}$ | UTS | 478 | 397 | 367 | 322 | 262 |
| | | $e_f$ | 13.0 | 7.0 | 7.2 | 8.5 | 12.0 |
| 26 | $Al_{93.44}Fe_{4.37}V_{0.47}Si_{1.70}$ | UTS | 469 | 381 | 355 | 311 | 259 |
| | | $e_f$ | 13.1 | 6.9 | 8.4 | 9.8 | 12.0 |
| 27 | $Al_{91.89}Fe_{5.09}V_{0.93}Si_{2.09}$ | UTS | 571 | 462 | 435 | 373 | 294 |
| | | $e_f$ | 9.4 | 5.2 | 6.0 | 8.1 | 10.8 |
| 28 | $Al_{91.92}Fe_{5.40}V_{0.59}Si_{2.10}$ | UTS | 596 | 466 | 424 | 368 | 296 |
| | | $e_f$ | 10.0 | 5.2 | 4.8 | 6.7 | 11.2 |
| 29 | $Al_{91.42}Fe_{5.36}V_{0.99}Si_{2.22}$ | UTS | 592 | 440 | 457 | 384 | 317 |
| | | $e_f$ | 10.7 | 4.4 | 5.0 | 6.9 | 10.0 |
| 30 | $Al_{91.44}Fe_{5.73}V_{0.62}Si_{2.22}$ | UTS | 592 | 491 | 455 | 382 | 304 |
| | | $e_f$ | 10.0 | 5.2 | 5.8 | 8.3 | 10.0 |
| 31 | $Al_{93.57}Fe_{4.29}V_{0.47}Si_{1.67}$ | UTS | 462 | 380 | 351 | 306 | 244 |
| | | $e_f$ | 13.0 | 7.8 | 9.0 | 10.5 | 12.4 |
| 32 | $Al_{93.52}Fe_{4.06}V_{0.75}Si_{1.67}$ | UTS | 437 | 372 | 341 | 308 | 261 |
| | | $e_f$ | 10.0 | 7.0 | 8.0 | 9.0 | 9.0 |
| 33 | $Al_{90.82}Fe_{6.06}V_{0.65}Si_{2.47}$ | UTS | 578 | 474 | 441 | 383 | 321 |
| | | $e_f$ | 6.2 | 3.8 | 4.3 | 5.8 | 6.8 |

EXAMPLE 34–35

The alloys of the invention are capable of producing consolidated articles which have high fracture toughness when measured at room temperature. Table 3 below shows the fracture toughness for selected consolidated articles of the invention. Each of the powder articles were consolidated by vacuum hot compaction at 350° C. and subsequently extruded at 385° C. at an extrusion ratio of 18:1. Fracture toughness measurements were made on compact tension (CT) specimens of the consolidated articles of the invention under the ASTM E399 standard.

TABLE 3

| Example | Alloy | Fracture Toughness (MPa $m^{\frac{1}{2}}$) |
|---|---|---|
| 34 | $Al_{93.52}Fe_{4.06}V_{0.75}Si_{1.67}$ | 30.4 |
| 35 | $Al_{93.44}Fe_{4.11}V_{0.75}Si_{1.70}$ | 32.3 |

EXAMPLE 36

The alloys of the invention are capable of producing consolidated articles which have an improved resistance to crack propogation as compared to those outside of the invention. Table 4 below indicates this improved resistance to crack growth for consolidated articles of the invention having essentially the same volume fracture and microstructural features as a consolidated article produced outside of this invention. Each of the powder articles were consolidated by vacuum hot compaction at 350° C. and subsequently extruded at 385° C. at an extrusion ratio of 18:1. Crack propagation measurements were made on compact tension (CT) specimens under the ASTM E-647 standard.

TABLE 4

| ALLOY | CRACK GROWTH RATE AT $\Delta K = 6$ MPA $m^{\frac{1}{2}}$ ($\times 10^{-8}$ m/cycle) |
|---|---|
| $Al_{93.52}Fe_{4.06}V_{0.75}Si_{1.67}$ | 3.47 |
| $Al_{93.67}Fe_{3.98}V_{0.82}Si_{1.53}$ (not of the present invention) | 7.90 |

EXAMPLE 37

Table 5 below shows the room temperature mechanical properties of a specific alloy of the invention that has been consolidated by forging. The alloy powder was vacuum hot pressed at a temperature of 350° C. for 1 hr. to provide a 95 to 100% density preform slug. These slugs were subsequently forged at a temperature from about 450° C. to 500° C. after holding at that temperature for 1 hr.

TABLE 5

| Alloy | | Tensile Properties Ultimate tensile strength MPa (UTS) and elongation of fracture % (ef) Test Temperature (°C.) 20 | 150 | 204 | 260 | 315 |
|---|---|---|---|---|---|---|
| $Al_{93.52}Fe_{4.06}V_{0.75}Si_{1.67}$ | UTS | 462 | 372 | 338 | 290 | 248 |
| | ef | 12.0 | 6.0 | 6.0 | 8.0 | 9.0 |

Having thus described the invention in rather full detail, it will be understood that these details need not be strictly adhered to but that various changes and modifications may suggest themselves to one skilled in the art, all falling within the scope of the invention as defined by the subjoining claims.

We claim:

1. A rapidly solidified aluminum-base alloy consisting essentially of the formula $Al_{bal}Fe_aSi_bV_c$, wherein "a" ranges from 3.0 to 7.1 at %, "b" ranges from 1.0 to 3.0 at %, "c" ranges from 0.25 to 1.25 at % and the balance is aluminum plus incidental impurities, with the provisos that (i) the ratio (Fe+V):Si ranges from about 2.33:1 to 3.33:1, and (ii) the ratio Fe:V ranges from 11.5:1 to 5:1.

2. A method for making a rapidly solidified aluminum-based alloy, comprising the steps of:

(a) forming a melt of the alloy recited in claim 1; and (b) quenching the melt at a cooling rate of at least $10^{5°}$ C./sec.

3. A method for forming a consolidated metal alloy article wherein particles composed of an aluminum-base alloy consisting essentially of the formula $Al_{bal}Fe_aSi_bV_c$, wherein "a" ranges from 3.0 to 7.1 at %, "b" ranges from 1.0 to 3.0 at %, "c" ranges from 0.25 to 1.25 at % and the balance is aluminum plus incidental impurities, with the provisos that (i) the ratio (Fe+V):Si ranges from about 2.33:1 to 3.33:1, and (ii) the ratio Fe:V ranges from 11.5:1 to 5:1 are heated in a vacuum to a temperature ranging from about 300° to 500° C. and compacted.

4. A method as recited in claim 3, wherein said heating step comprises heating said particles to a temperature ranging from 325° to 450° C.

5. A method for forming a consolidated metal alloy article wherein:

(a) particles composed of an aluminum-base alloy consisting essentially of the formula $Al_{bal}Fe_aSi_bV_c$, wherein "a" ranges from 3.0 to 7.1 at %, "b" ranges from 1.0 to 3.0 at %, "c" ranges from 0.25 to 1.25 at % and the balance is aluminum plus incidental impurities, with the provisos that (i) the ratio (Fe+V):Si ranges from about 2.33:1 to 3.33:1, and (ii) the ratio Fe:V ranges from 11.5:1 to 5:1 are placed in a container, heated to a temperature ranging from about 300° to 500° C., evacuated and sealed under vacuum, and (b) said container and contents are heated to a temperature ranging from 300° to 500° C. and compacted.

6. A method as recited in claim 5, wherein said heating step comprises heating said container and contents to a temperature ranging from 325° C. to 450° C.

7. A consolidated metal article compacted from particles of an aluminum base alloy consisting essentially of the formula $Al_{bal}Fe_aSi_bV_c$, "a" ranges from 3.0 to 7.1 at %, "b" ranges from 1.0 to 3.0 at %, "c" ranges from 0.25 to 1.25 at % and the balance is aluminum plus incidental impurities, with the provisos that (i) the ratio (Fe+V):Si ranges from about 2.33:1 to 3.33:1, and (ii) the ratio Fe:V ranges from 11.5:1 to 5:1 said consolidated article being composed of an aluminum solid solution phase containing therein a substantially uniform distribution of dispersed, intermetallic phase precipitates, each said precipitates measuring less than about 100 nm. in any dimension thereof.

8. A consolidated metal article as recited in claim 7, wherein said article has the form of a sheet having a width of at least 0.5" and a thickness of at least 0.010".

9. A consolidated metal article as recited in claim 8, wherein said particles of aluminum-base alloy are compacted at a temperature of about 400° to 550° C. and each of the said dispersed intermetallic precipitates measures less than 100 nm. in any dimension thereof.

10. A consolidated metal article as recited in claim 7, wherein the volume fraction of said fine intermetallic precipitates ranges from about 16 to 45%.

11. A consolidated metal article as recited in claim 7, wherein said article is compacted by forging without substantial loss of its mechanical properties.

12. A consolidated metal article as recited in claim 7, wherein said article is compacted by extruding through a die into bulk shapes.

* * * * *

UNITED STATES PATENT AND TRADEMARK OFFICE

CERTIFICATE OF CORRECTION

PATENT NO. : 4,879,095

DATED : November 7, 1989

INVENTOR(S) : Colin M. Adam et al

It is certified that error appears in the above-identified patent and that said Letters Patent is hereby corrected as shown below:

Columns 7 and 8 should be added as per attached sheet.

Signed and Sealed this

Ninth Day of October, 1990

*Attest:*

*Attesting Officer*

HARRY F. MANBECK, JR.

*Commissioner of Patents and Trademarks*

TABLE 5

| Alloy | | Tensile Properties Ultimate tensile strength MPa (UTS) and elongation of fracture % (ef) Test Temperature (°C.) 20 | 150 | 204 | 260 | 315 |
|---|---|---|---|---|---|---|
| $Al_{93.52}Fe_{4.06}V_{0.75}Si_{1.67}$ | UTS | 462 | 372 | 338 | 290 | 248 |
| | ef | 12.0 | 6.0 | 6.0 | 8.0 | 9.0 |

Having thus described the invention in rather full detail, it will be understood that these details need not be strictly adhered to but that various changes and modifications may suggest themselves to one skilled in the art, all falling within the scope of the invention as defined by the subjoining claims.

We claim:

1. A rapidly solidified aluminum-base alloy consisting essentially of the formula $Al_{bal}Fe_aSi_bV_c$, wherein "a" ranges from 3.0 to 7.1 at %, "b" ranges from 1.0 to 3.0 at %, "c" ranges from 0.25 to 1.25 at % and the balance is aluminum plus incidental impurities, with the provisos that (i) the ratio (Fe+V):Si ranges from about 2.33:1 to 3.33:1, and (ii) the ratio Fe:V ranges from 11.5:1 to 5:1.

2. A method for making a rapidly solidified aluminum-based alloy, comprising the steps of:

(a) forming a melt of the alloy recited in claim 1; and (b) quenching the melt at a cooling rate of at least $10^5$° C./sec.

3. A method for forming a consolidated metal alloy article wherein particles composed of an aluminum-base alloy consisting essentially of the formula $Al_{bal}Fe_aSi_bV_c$, wherein "a" ranges from 3.0 to 7.1 at %, "b" ranges from 1.0 to 3.0 at %, "c" ranges from 0.25 to 1.25 at % and the balance is aluminum plus incidental impurities, with the provisos that (i) the ratio (Fe+V):Si ranges from about 2.33:1 to 3.33:1, and (ii) the ratio Fe:V ranges from 11.5:1 to 5:1 are heated in a vacuum to a temperature ranging from about 300° to 500° C. and compacted.

4. A method as recited in claim 3, wherein said heating step comprises heating said particles to a temperature ranging from 325° to 450° C.

5. A method for forming a consolidated metal alloy article wherein:

(a) particles composed of an aluminum-base alloy consisting essentially of the formula $Al_{bal}Fe_aSi_bV_c$, wherein "a" ranges from 3.0 to 7.1 at %, "b" ranges from 1.0 to 3.0 at %, "c" ranges from 0.25 to 1.25 at % and the balance is aluminum plus incidental impurities, with the provisos that (i) the ratio (Fe+V):Si ranges from about 2.33:1 to 3.33:1, and (ii) the ratio Fe:V ranges from 11.5:1 to 5:1 are placed in a container, heated to a temperature ranging from about 300° to 500° C., evacuated and sealed under vacuum, and (b) said container and contents are heated to a temperature ranging from 300° to 500° C. and compacted.

6. A method as recited in claim 5, wherein said heating step comprises heating said container and contents to a temperature ranging from 325° C. to 450° C.

7. A consolidated metal article compacted from particles of an aluminum base alloy consisting essentially of the formula $Al_{bal}Fe_aSi_bV_c$, "a" ranges from 3.0 to 7.1 at %, "b" ranges from 1.0 to 3.0 at %, "c" ranges from 0.25 to 1.25 at % and the balance is aluminum plus incidental impurities, with the provisos that (i) the ratio (Fe+V):Si ranges from about 2.33:1 to 3.33:1, and (ii) the ratio Fe:V ranges from 11.5:1 to 5:1 said consolidated article being composed of an aluminum solid solution phase containing therein a substantially uniform distribution of dispersed, intermetallic phase precipitates, each said precipitates measuring less than about 100 nm. in any dimension thereof.

8. A consolidated metal article as recited in claim 7, wherein said article has the form of a sheet having a width of at least 0.5" and a thickness of at least 0.010".

9. A consolidated metal article as recited in claim 8, wherein said particles of aluminum-base alloy are compacted at a temperature of about 400° to 550° C. and each of the said dispersed intermetallic precipitates measures less than 100 nm. in any dimension thereof.

10. A consolidated metal article as recited in claim 7, wherein the volume fraction of said fine intermetallic precipitates ranges from about 16 to 45%.

11. A consolidated metal article as recited in claim 7, wherein said article is compacted by forging without substantial loss of its mechanical properties.

12. A consolidated metal article as recited in claim 7, wherein said article is compacted by extruding through a die into bulk shapes.

* * * * *